United States Patent [19]

Kington

[11] Patent Number: 4,989,667

[45] Date of Patent: Feb. 5, 1991

[54] SHELL MOULDS FOR CASTING METALS

[75] Inventor: Alan D. Kington, Bristol, England

[73] Assignee: Rolls-Royce plc, London, England

[21] Appl. No.: 437,626

[22] Filed: Nov. 17, 1989

[30] Foreign Application Priority Data

Nov. 21, 1988 [GB] United Kingdom ..... 8827178

[51] Int. Cl.[5] ..... B22C 1/02

[52] U.S. Cl. ..... 164/519; 164/361

[58] Field of Search ..... 164/519, 122.1, 122.2, 164/361

[56] References Cited

U.S. PATENT DOCUMENTS

| | | | |
|---|---|---|---|
| 3,266,106 | 8/1966 | Lirones | 164/519 |
| 3,751,276 | 8/1973 | Beyer et al. . | |
| 3,752,689 | 8/1973 | Moore, Jr. . | |
| 3,862,660 | 1/1975 | Sakabe et al. . | |
| 4,223,716 | 9/1980 | Ostrowski | 164/519 |
| 4,244,551 | 1/1981 | Terkelsen et al. | 164/528 |
| 4,533,394 | 8/1985 | Watts . | |
| 4,655,276 | 4/1987 | Bird et al. | 164/519 |
| 1,043,580 | 9/1966 | UK . | |
| 1,136,883 | 7/1982 | USSR . | |
| 1,458,102 | 12/1968 | Fed. Republic of Germany . | |
| 6,012,247 | 1/1985 | Japan . | |

OTHER PUBLICATIONS

"Introduction to Ceramics", by W. D. Kingery, pp. 472–473. John Wiley and Sons, Inc. 1960.

European Search Report No. EP89312042, dated 10/7/90

*Primary Examiner*—Kuang Y. Lin

*Attorney, Agent, or Firm*—Oliff & Berridge

[57] ABSTRACT

A shell mould comprising an inner layer of ceramic material which has a predetermined co-efficient of thermal expansion at a predetermined temperature and an outer ceramic layer of lower thermal co-efficient than the inner layer. The outer layer subjects the inner layer to compression on firing and during casting.

4 Claims, 1 Drawing Sheet

SHELL MOULDS FOR CASTING METALS

BACKGROUND OF THE INVENTION

This invention relates to the casting of metal components and in particular to the manufacture of ceramic shell moulds.

Ceramic shell moulds are made by dipping a wax pattern of the component to be cast in a slurry consisting of a filler and a binder and stuccoing ceramic particles on the deposited slurry.

One of the prime considerations for a successful mould material is to achieve a co-efficient of thermal expansion close to that of the metal to be cast in order to minimise stress on the casting after solidification.

Prior known ceramic shell moulds are usually a compromise between suitable co-efficients of expansion and high temperature strength. The RR formulation shell mould material (PDS93) comprises a slurry of zirconium silicate particles in an alcohol based silica binder with a stucco material of tabular alumina particles. Whilst this material has relatively high thermal expansion characteristics for the casting of nickel super alloys it softens at high temperatures and tends to bulge under the metal pressure. Silica has a very low thermal expansion co-efficient and is very rigid and strong at high temperatures.

SUMMARY OF THE INVENTION

The invention as claimed overcomes the problem of distortions due to the mould bulging during casting.

According to the invention there is provided a shell mould comprising an inner layer which has a first co-efficient of thermal expansion and an outer layer which has a second lower co-efficient of thermal expansion so as to subject the inner layer to compression when the mould is heated during firing and casting.

DESCRIPTION OF THE PREFERRED EMBODIMENT

Figure 1:
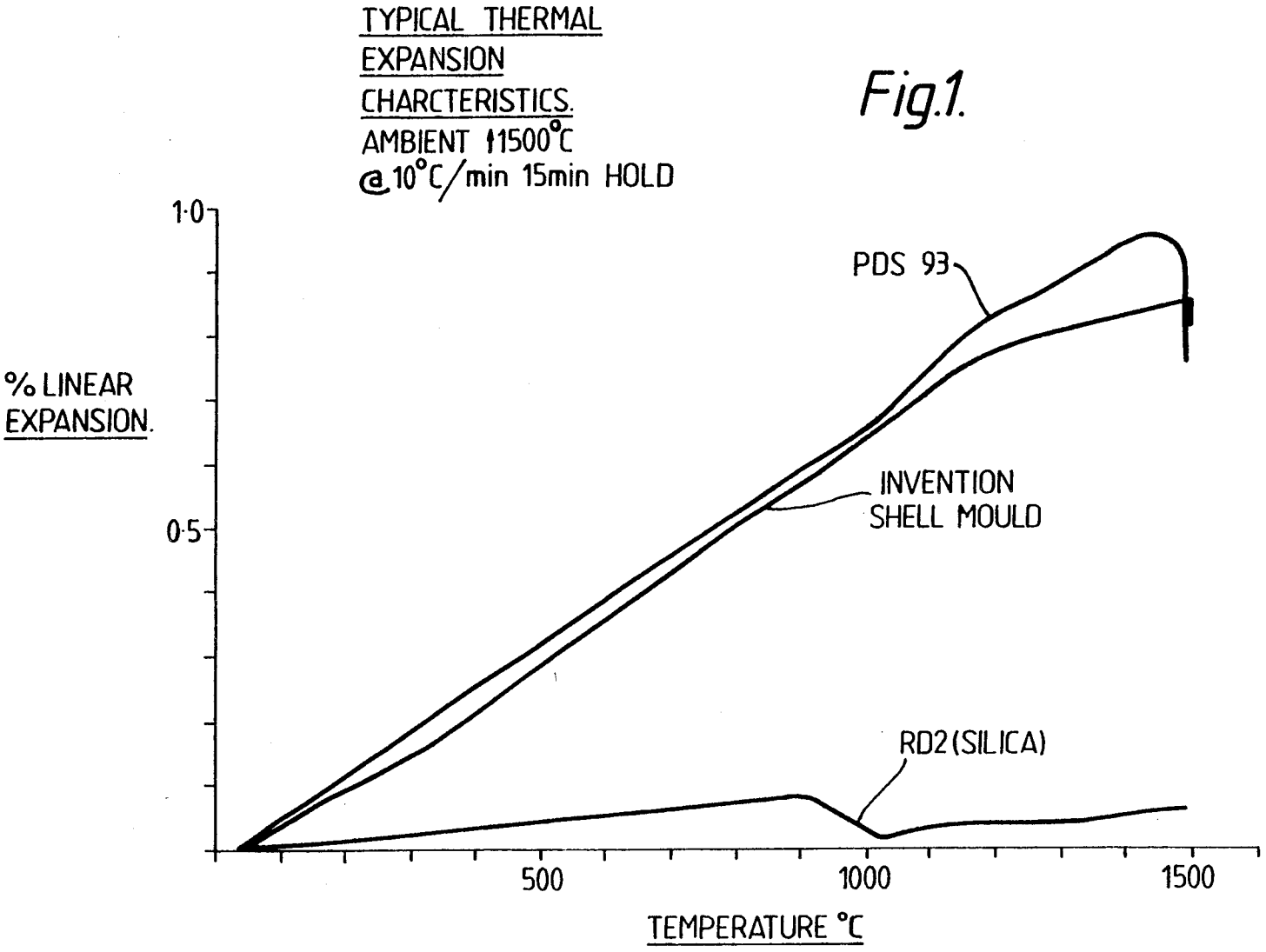

An embodiment of the present invention will now be described, by way of an example only, with reference to the accompanying drawing which is a graph showing linear expansion of ceramic shell mould materials plotted against various temperatures.

Referring to the graph, the standard shell mould material identified as PDS93 is made by dipping a wax pattern of the component to be cast in a slurry comprising zirconium silicate particles suspended in an alcohol silica based binder and stuccoing tabulated alumina particles onto the slurry coated wax pattern. Successive dipping in the slurry and stuccoing is used to build up the required thickness of shell. The shell mould is then fired and the wax removed. As will be seen, the percentage linear expansion follows almost a straight line curve. This thermal expansion characteristic is preferred for casting nickel based superalloys because it is not too dissimilar to the super alloys.

On the other hand the material identified as RD2 is made by dipping a wax pattern in a slurry comprising silica particles in a water based binder and stuccoing silica on to the slurry. Here again, the mould thickness is achieved by successively dipping in the slurry and stuccoing. The wax pattern is removed and the shell mould fired. The RD2 material has a much lower percentage linear expansion.

The third line of this graph represents the percentage linear expansion of a shell mould constructed in accordance with the present invention. This material is made by first forming a primary coating of the PDS93 material by successively dipping in the slurry and stuccoing. The mould is then overcoated with a thin layer of the RD2 silica material. This layer is formed by dipping the PDS 93 shell into a slurry comprising silica particles in a water based binder and stuccoing silica particles onto the slurry. The wax pattern is melted out and the shell mould is fired.

The resulting shell mould has a multiple layer structure comprising a slightly deformable inner layer surrounded by a thin outer shell of comparatively rigid material of lower expansion co-efficient which at high temperature imposes compressive stress on the inner layer. The outer layer acts like an "egg shell" and serves to subject the inner layer or layers of PDS 93 material to compression and thus able to resist deformation when molten metal is poured into the mould.

The following table shows the Modulus of Rupture (MOR) and creep of the materials shown in FIG. 1.

| PROPERTIES | STANDARD SHELL PDS93 | ALL SILICA SHELL RD2 | EGG-SHELL |
|---|---|---|---|
| M.O.R. 1450° C. | 300–500 p.s.i. | 1500–2000 p.s.i. | 525 p.s.i. |
| CREEP 1450° C. 100 p.s.i LOADING | 0.3–0.5 mm/2 mins | 0.05–0.12 mm/2 mins | 0.16–0.22 mm/2 mins |

From the table and FIG. 1 it will be seen that a shell mould constructed in accordance with the present invention, has a MOR of about 525 pounds per square inch which is comparable to that of the PDS93 material but has a creep characteristic comparable to that of the RD2 material.

It will be understood that the invention may be carried into practice using materials other than those described above. Those skilled in the relevant art will be able to select materials exhibiting the necessary properties to provide a relatively weak shell clad by a stronger thin outer shell and in which the material of the rigid outer cladding shell has a lower co-efficient of expansion relative to the more easily deformed inner shell.

I claim:

1. A shell mould comprising an inner layer of a first material of zirconium silicate particles suspended in an alcohol based binder on to which is stuccoed tabulated alumina particles which has a first co-efficient of thermal expansion and a predetermined creep characteristic at a predetermined temperature, and an outer layer of a second material which has a second lower co-efficient of thermal expansion and a lower creep characteristic than the inner layer at the predetermined temperature so as to subject the inner layer to compression when the mould is heated during firing and casting.

2. A shell mould according to claim 1 wherein the second material of the outer layer comprises silica.

3. A method of manufacturing a shell mould comprising the step of forming on a wax pattern of the component to be cast a first layer comprising a ceramic material which has a first coefficient of thermal expansion by dipping the wax pattern in a slurry comprising zirconium silicate particles in a binder and stuccoing on the slurry particles of tabulated alumina, forming on the first layer a second layer comprising a ceramic material which has a second relatively lower co-efficient of thermal expansion than the first layer, and subsequently removing the pattern.

4. A method according to claim 3 wherein the second outer layer is formed by dipping the wax pattern coated by the first layer in a slurry comprising silica particles in a binder and stuccoing silica particles on to the slurry.

* * * * *